US005203266A

United States Patent [19]

Stevens

[11] Patent Number: 5,203,266

[45] Date of Patent: Apr. 20, 1993

[54] FOLDABLE TABLE HAVING CENTERLINE FOLDING LEAVES

[75] Inventor: Kenneth V. Stevens, Brooklyn, N.Y.

[73] Assignee: Colgate-Palmolive Co., Piscataway, N.J.

[21] Appl. No.: 414,483

[22] Filed: Sep. 29, 1989

[51] Int. Cl.[5] ..... A47B 3/00

[52] U.S. Cl. ..... 108/112; 108/111; 108/115

[58] Field of Search ..... 108/64, 65, 114, 115, 108/134, 151, 111, 112

[56] References Cited

U.S. PATENT DOCUMENTS

| | | | |
|---|---|---|---|
| 53,786 | 4/1866 | Colbert . | |
| 198,454 | 12/1877 | French . | |
| 827,540 | 7/1906 | Krahmer . | |
| 1,079,057 | 11/1913 | Meyer . | |
| 1,455,395 | 8/1921 | Exum . | |
| 1,858,857 | 6/1930 | Huntley . | |
| 2,010,278 | 8/1935 | Snyder | 311/96 |
| 2,146,413 | 1/1936 | Aron | 211/2 |
| 2,725,987 | 7/1952 | Howe | 211/3 |
| 2,784,999 | 3/1957 | Hunt | 296/22 |
| 2,800,127 | 7/1957 | Flynn | 126/141 |
| 2,850,341 | 9/1958 | Spinner | 311/3 |
| 2,926,794 | 12/1956 | Karoff | 211/149 |
| 3,093,247 | 6/1963 | Erickson | 108/114 |
| 3,101,731 | 8/1963 | Stiglin | 135/5 |
| 3,132,641 | 5/1964 | Schafer | 126/268 |
| 3,256,037 | 6/1966 | Giambalvo | 108/115 |
| 3,267,885 | 8/1966 | Shore | 108/112 |
| 3,318,269 | 5/1967 | Kinn | 108/112 |
| 3,347,184 | 10/1967 | Kiraly | 108/17 |
| 3,415,208 | 12/1968 | Thoreson | 108/94 |
| 3,436,092 | 4/1969 | Werner | 280/36 |
| 4,478,428 | 10/1984 | Ziliani | 280/651 |

FOREIGN PATENT DOCUMENTS

| | | | |
|---|---|---|---|
| 1308044 | 6/1969 | United Kingdom . | |
| 1235709 | 6/1971 | United Kingdom | 108/115 |

*Primary Examiner*—James R. Brittain
*Assistant Examiner*—Gerald A. Anderson
*Attorney, Agent, or Firm*—Richard J. Ancel; Robert C. Sullivan; Murray M. Grill

[57] ABSTRACT

A foldable table assembly has a base frame formed by transverse lower base pieces, longitudinally opposing pairs of spaced-apart upright pieces having pivot mounts on their upper ends, longitudinal stretchers extending between the upright pieces, and end sections between the upright pieces defining a centerline of the assembly and having leaf stops on their upper ends, for independently holding respective table leaves mounted by pivot pins to the pivot mounts on each transverse side of the centerline. The tables leaves have a total span greater than the width of the upright pieces, and fold vertically for storage within the width of the upright pieces. A longitudinal upper shelf is provided on one transverse side supported by upright posts at the centerline above the corresponding table leaf, and is foldable to a vertical storage position. Round banquet table leaves can be interchangeably mounted in place of rectangular buffer table leaves by removing the pivot pins from the pivot mounts.

12 Claims, 10 Drawing Sheets

FOLDABLE TABLE HAVING CENTERLINE FOLDING LEAVES

FIELD OF THE INVENTION

This invention generally relates to a foldable table, and particularly to one having table and shelf portions which fold vertically for compact storage.

BACKGROUND ART

Many different types of foldable tables are known in the prior art having various portions which fold up in order to allow for their compact storage. For example, various types of folding legs, add-on leaves, drop leaves, or vertically pivotable or removable table tops are often used. In particular, in the hotel and hospitality industries, it is desireable to provide folding tables which are mobile (on wheels), can fold up vertically in a small storage space, and allow flexibility and convenience for a wide range of different uses, such as as a buffet table, a banquet or catering table, and/or a registration table.

One example of a commercially available foldable table has a lower table top and an upper recessed shelf, both of which are divided at the middle of their longitudinal lengths. An arrangement of pivotable arms and foldable supports allow the table top and shelf sections to be folded and raised at the midsection to vertical positions nested in parallel with each other around the collapsed arms and supports for storage. This type of folding table can be used as a two-tiered buffet table and as a registration table.

The foldable tables of the prior art have often the disadvantage that the sturdiness of the base to support heavy loads on the table top and the table surface area are often sacrificed in order to make the folding structure completely collapsible. In the particular example described above, the surface area of the table top is insufficient for catering and banquet uses, and the table top and shelf sections all fold up together, thereby allowing little flexibility to alter their configuration to accomodate different types of uses or obstacles such as narrow doors and hallways.

SUMMARY OF THE INVENTION

It is therefore a principal object of the invention to provide a foldable table which has the combined advantages of sturdiness, foldability for compact storage, and flexibility to alter the configuration for different uses or environments. It is a specific object that the foldable table be capable of use as a buffet table, a registration table, a catering table, and a banquet table simply by altering the configuration of its parts.

In accordance with the present invention, a foldable table assembly comprises:

(a) a base frame including first and second lower base pieces spaced apart in a longitudinal direction and extending in parallel with each other in a transverse direction perpendicular to the longitudinal direction, a first pair and a second pair of upright pieces, each pair having their lower ends fixed to a respective one of the base pieces and being spaced apart by a given width in the transverse direction and extending vertically in parallel, said upright pieces having pivot mounts provided respectively on their upper ends, and at least one longitudinal stretcher having its opposite ends fixed to the upright pieces to provide said base frame with structural rigidity;

(b) first and second end sections each respectively disposed at a midpoint of the given width between the spaced-apart upright pieces of said first and second pairs and each having a pair of leaf stops fixed on an upper end of the end section extending oppositely in the transverse direction a short length toward the corresponding upper ends of the upright pieces, wherein said first and second end sections define a centerline of the assembly between the upright pieces with the upper ends of the upright pieces being disposed on respective transverse sides of said centerline; and (c) first and second table leaves each extending a given length in the longitudinal direction and having a width in the transverse direction that is substantially greater than one-half the given width between the pairs of upright pieces, wherein each table leaf has a pair of pivot sections including pivot pins fixed to a lower surface thereof and spaced apart in the longitudinal direction for pivotably mounting each table leaf to respective pivot mounts on the upper ends of the upright pieces on each transverse side of the centerline of the assembly, and has a pair of cutout portions which are formed at an inner longitudinal edge of the table leaf spaced apart in the longitudinal direction for fitting around the respective end sections and abutting with the leaf stops to hold the table leaf in a horizontal position in conjunction with the pivot mounts on the upper ends of the upright pieces, said table leaves thereby each being independently pivotable on the respective pivot mounts between a horizontal position for use and a vertical position in which the inner longitudinal edges are released from the leaf stops and the table leaves are pivoted upright in parallel with each other between the upright pieces for storage.

In a preferred embodiment, the foldable table assembly includes a longitudinally extending upper shelf on one transverse side of the centerline of the assembly having a pair of pivot sections spaced apart in the longitudinal direction along one longitudinal edge thereof and mounted respectively to upper ends of a pair of upright posts having their lower ends held respectively in the end sections of the base frame, and a pair of folding legs pivotably mounted along an opposite longitudinal edge of the upper shelf spaced apart in the longitudinal direction for supporting the upper shelf in a horizontal position on the table leaf on the corresponding transverse side, wherein the upper shelf is pivotable, upon folding of the legs, to a vertical position in parallel with the pair of upright posts. The table leaves may also be in the form of semicircular banquet-table leaves which can be interchangeably mounted to the upright pieces of the base frame, in place of rectangular buffet-table leaves, through pivot pins removably held to the respective pivot sections by threaded cap nuts. The upper shelf is removable for the banquet table configuration by removing the upright posts from slots in the end sections of the base frame.

Other objects, features and advantages of the present invention will be apparent from the following detailed description of the preferred embodiments with reference to the drawings, of which:

DETAILED DESCRIPTION OF PREFERRED EMBODIMENTS

Figure 1:
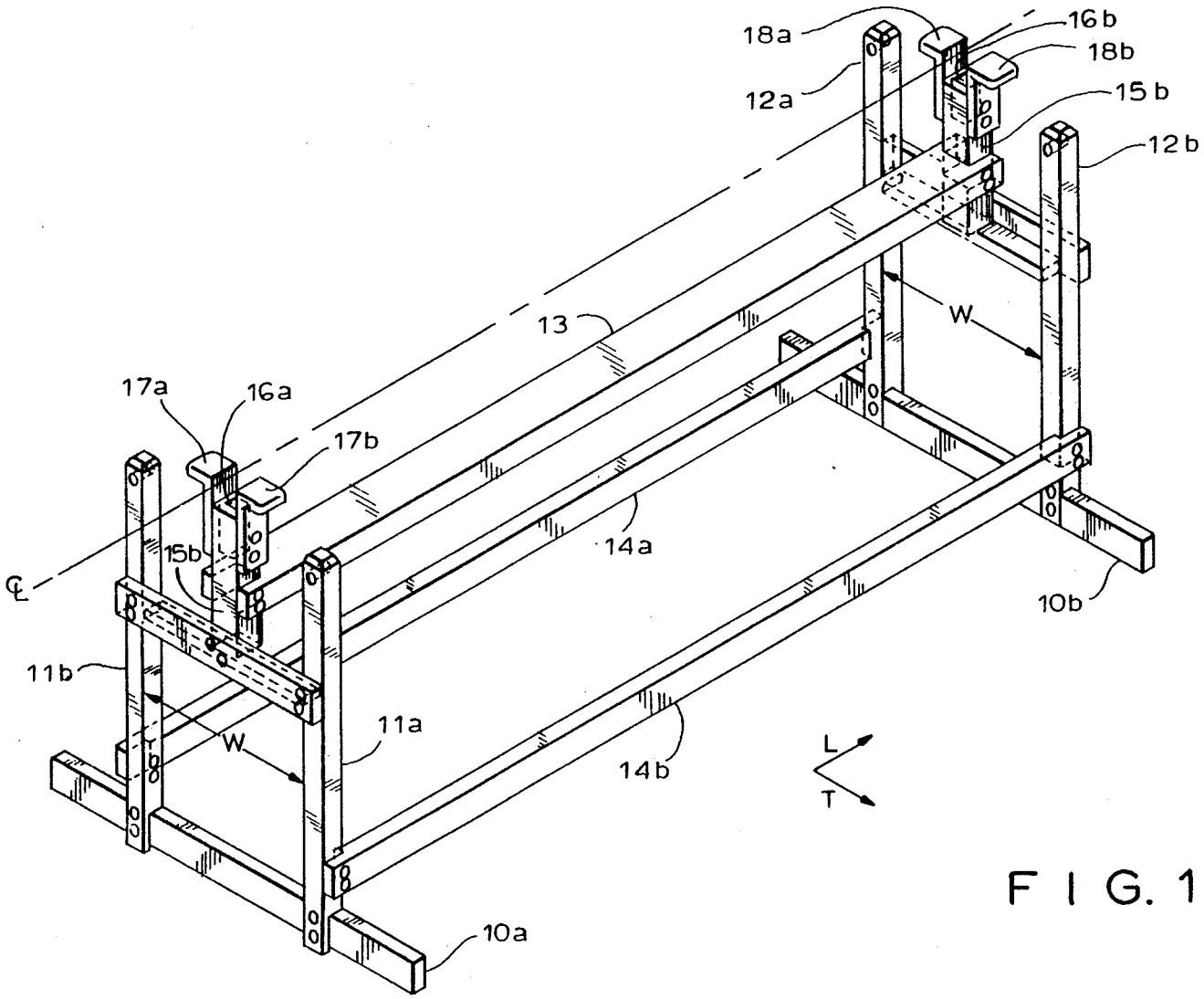
FIG. 1 is a perspective view showing one embodiment of a base frame for the foldable table assembly in accordance with the invention.

Referring to FIG. 1, a base frame for a foldable table assembly in accordance with the principles of the invention includes first and second lower base pieces 10*a*, 10*b* which are spaced apart in a longitudinal direction L and extend in parallel with each other in a transverse direction T perpendicular to the longitudinal direction, a first pair 11*a*, 11*b* and a second pair 12*a*, 12*b* of upright pieces having their lower ends fixed to a respective one of the base pieces 10*a*, 10*b*, a pair of end sections 15*a*, 15*b* fixedly mounted in the middle of the upright pieces at each longitudinal end of the base frame by means of cross bars or other structural members, and an upper longitudinal stretcher 13 and a pair of lower longitudinal stretchers 14*a*, 14*b* to provide the base frame with structural rigidity.

The pairs of upright pieces 11*a*, 11*b* and 12*a*, 12*b* are spaced apart by a given width W in the transverse direction T and extend vertically in parallel. The upright pieces have their lower ends fixed to the respective base pieces and pivot mounts (to be described further herein) provided respectively on their upper ends. The upper stretcher has its ends fixed to the end sections 15*a*, 15*b*. Alternatively, a pair of upper stretchers may have their ends fixed to the upright pieces. The lower stretchers have their ends fixed to the upright pieces adjacent the base pieces 10*a*, 10*b*. The end sections 15*a*, 15*b* have respective open slots 16*a*, 16*b* facing upwards and respective pairs of leaf stops 17*a*, 17*b* and 18*a*, 18*b* extending oppositely in the transverse direction a short length toward the corresponding upper ends of the upright pieces 11*a*, 11*b* and 12*a*, 12*b*. The first and second end sections 15*a*, 15*b* define a centerline CL of the assembly at the midline between the respective pairs of upright pieces. The upper ends of the upright pieces are disposed on respective transverse sides of the centerline.

Figure 2:
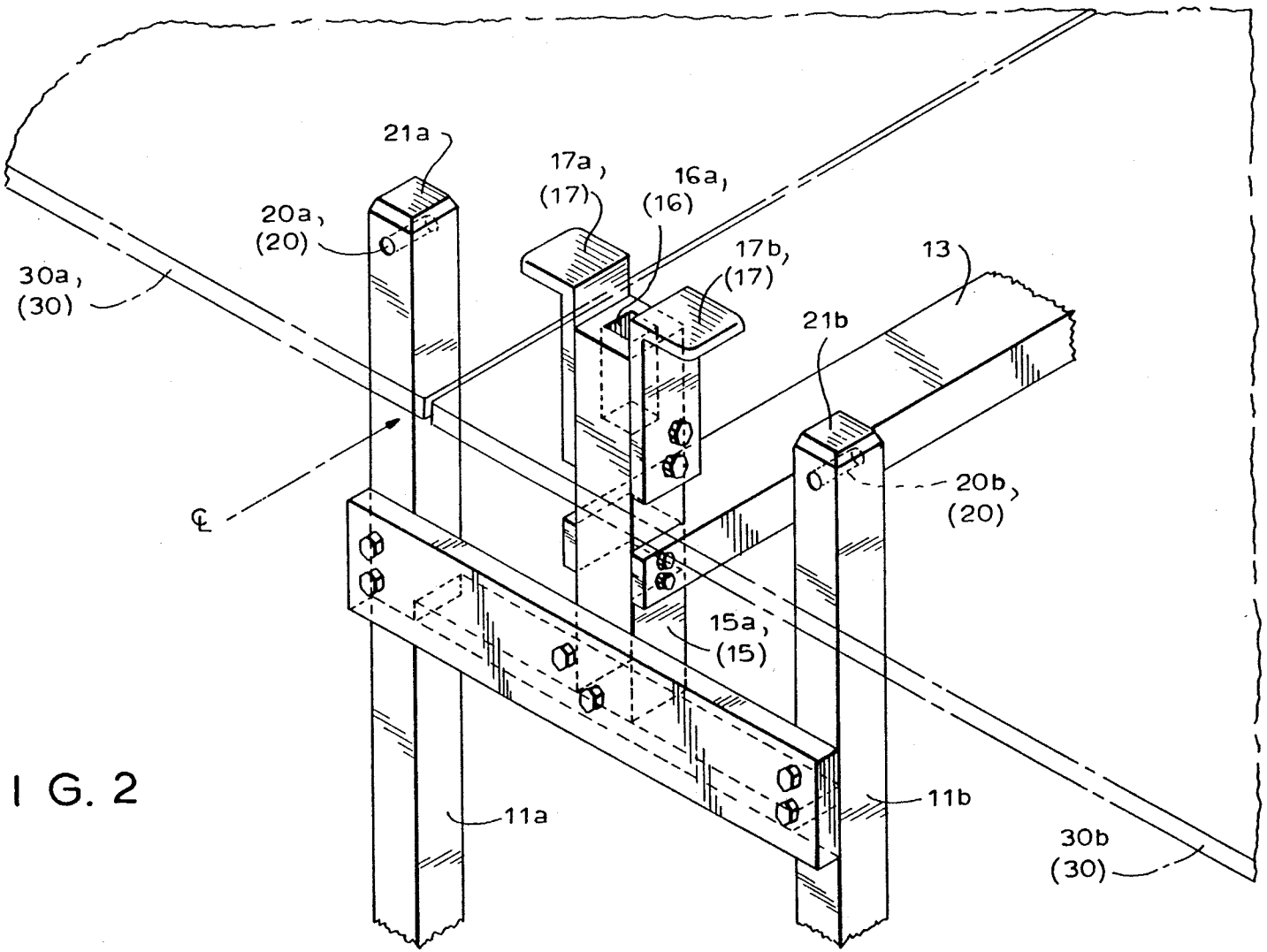
FIG. 2 is a detailed perspective view, in partial section, showing the upright pieces and end sections of the base frame.

In the detailed view of FIG. 2, the upper ends of the upright pieces at one longitudinal end of the base frame are shown provided with respective through holes 20*a*, 20*b* for the pivot pins used to mount table leaves on the base frame, as described further below. The upper ends have bevelled upper surfaces 21*a*, 21*b* to allow the leaves to be pivoted thereon between horizontal (use) and vertical (storage) positions. Similar components are provided on the upper ends of the upright pieces at the other longitudinal end of the base frame.

A pair of table leaves 30*a*, 30*b* (shown in phantom line in FIG. 2) are mounted on respective transverse sides of the centerline CL by pivot sections including pivot pins inserted through the corresponding through-holes 20 at the upper ends of the upright pieces. Each table leaf 30 may be independently moved between horizontal and vertical positions, to allow flexibility in setting various table configurations. The table leaves are held in the horizontal position by the leaf stops 17 abutting their upper surfaces along their interior longitudinal edges. The table leaves are half sections of the overall table area divided along the centerline CL.

Figure 3:
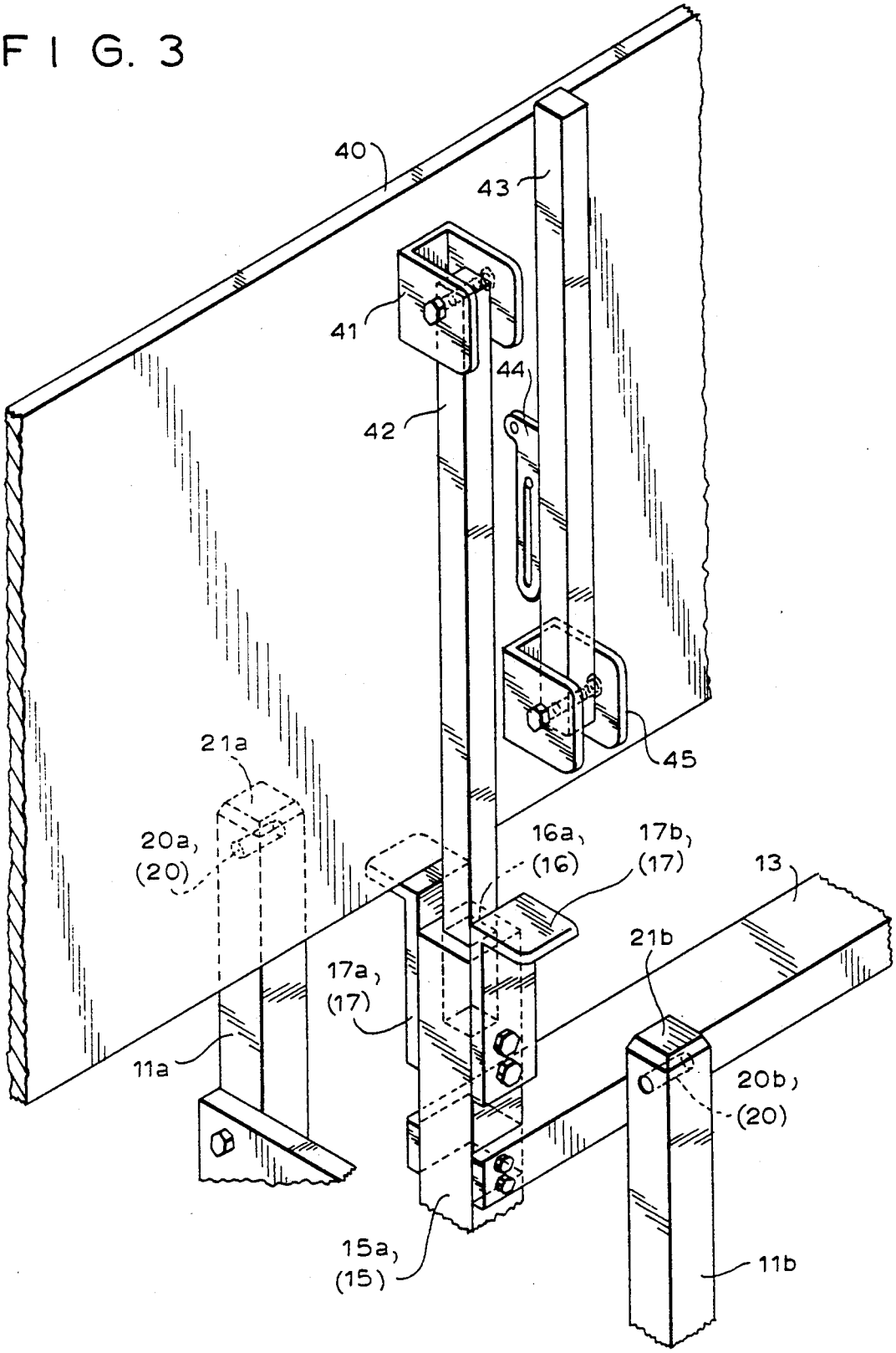
FIG. 3 is a perspective view, in partial section, of an upper shelf for the foldable table assembly.
Figures 4A, 4B, 4C:
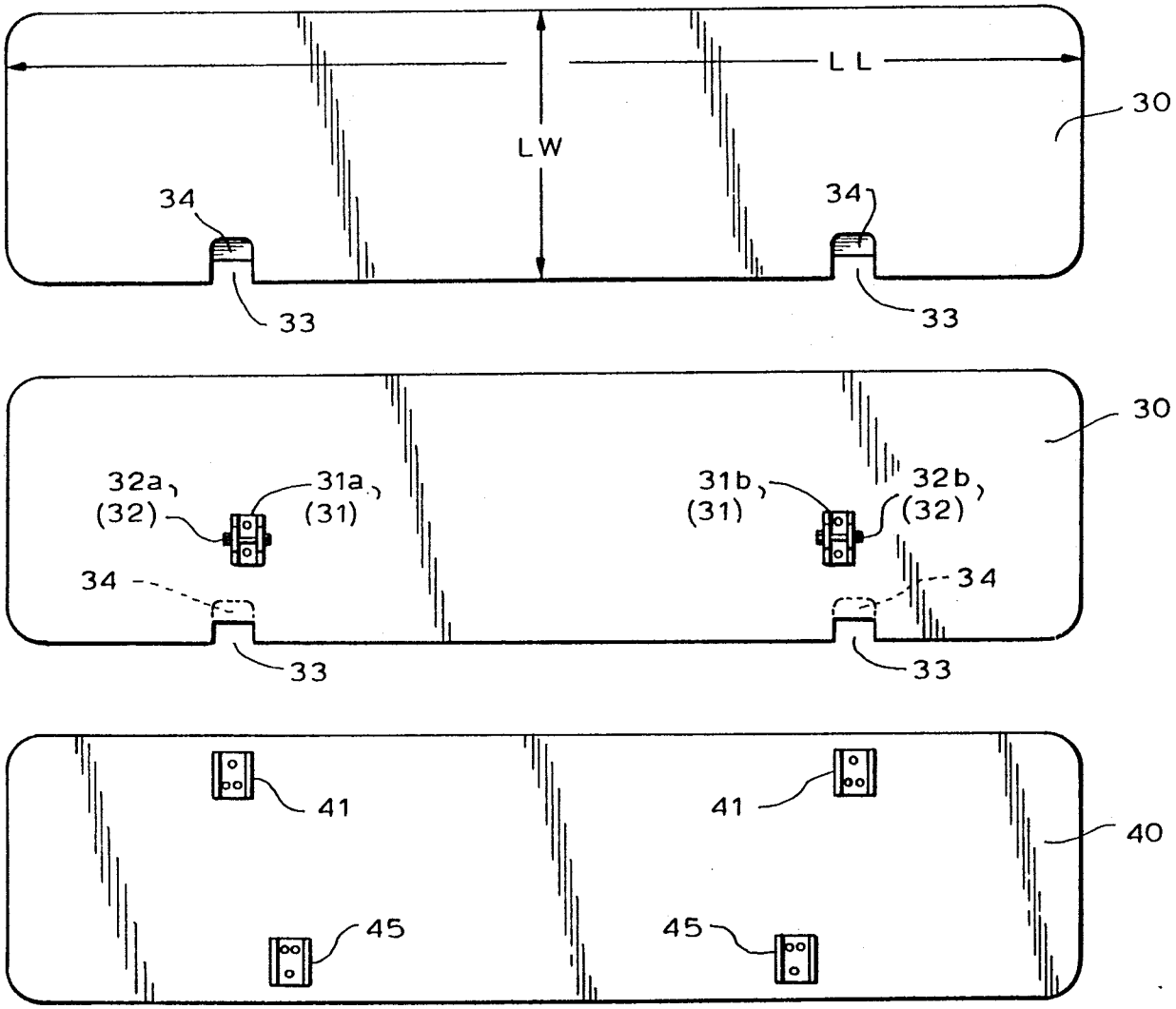
FIG. 4A is a top view.
FIG. 4B is a bottom view, of a rectangular, buffet-table leaf.
FIG. 4C is a bottom view of the corresponding upper shelf.

In FIG. 3, an assembly for mounting an upper shelf 40 to the base frame is shown having pivot sections 41 which are spaced apart along one longitudinal edge of the upper shelf and mounted to the upper ends of upright posts 42 having their lower ends held in the open slots 16 of the end sections 15 of the base frame. Folding legs 43 are pivotably mounted by pivot sections 45 along an opposite longitudinal edge for supporting the upper shelf in a horizontal position on the table leaf on the corresponding transverse side. Diagonal braces 44 are provided to lock the legs in the extended, use position. The upper shelf is pivotable from the horizontal position to the vertical position for storage by folding the legs and braces and pivoting the shelf to the vertical position in parallel with the upright posts 42.

In FIGS. 3A–3C, examples of a rectangular buffet-table leaf 30 and corresponding upper shelf 40 are shown. Each rectangular table leaf 30 has a given length LL in the longitudinal direction and a width LW in the transverse direction that is substantially greater than one-half the given width W between the pairs of upright pieces. The table leaf has a pair of pivot sections 31*a*, 31*b*, including pivot pins 32*a*, 32*b*, that are fixed to the lower surface thereof spaced apart in the longitudinal direction for mounting the table leaf to respective upper ends of the upright pieces. Cutouts 33 at the interior longitudinal edge of the table leaf provide clearance around the end sections 15 of the base frame, so that the interior longitudinal edges of the table leaves meet together without an unsightly gap in between. A recessed step portion 34 may also be provided adjacent each cutout for receiving the leaf stops 17 so that they lie flush with the upper surface of the table.

Figure 5:
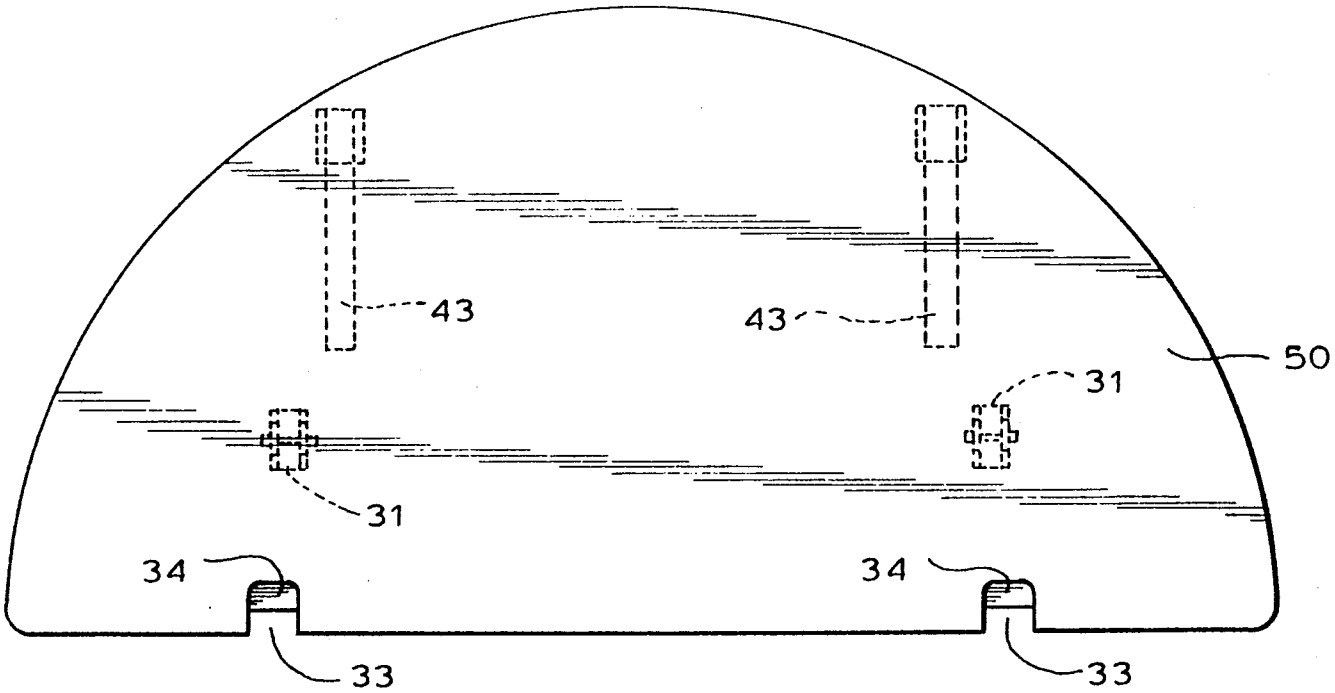
FIG. 5 is a bottom view of a semicircular banquet-table leaf.

The upper shelf 40 is preferable of the same shape and dimensions as the table leaves so that it can be extended in a buffet table configuration with the two-tiered portion at the rear and the single table leaf at the front side. Alternatively, in a registration table configuration, the two-tiered side is presented to registrants while the other table leaf is used by a registrar. The table leaves may also be in the form of semicircular banquet-table leaves 50, as shown in FIG. 5, which can be interchangeably mounted to the upright pieces of the base frame, in place of the rectangular buffet-table leaves 30. To allow interchangeability of the leaves, threaded cap nuts are used to secure the pivot pins 32 to the respective pivot sections, so that they can be readily removed and inserted through the through holes 20 of the upright pieces to mount the new leaves. The upper shelf 40 is removed for the banquet table configuration by sliding the upright posts 42 from their slots 16 in the end sections 15 of the base frame.

Figure 6A:
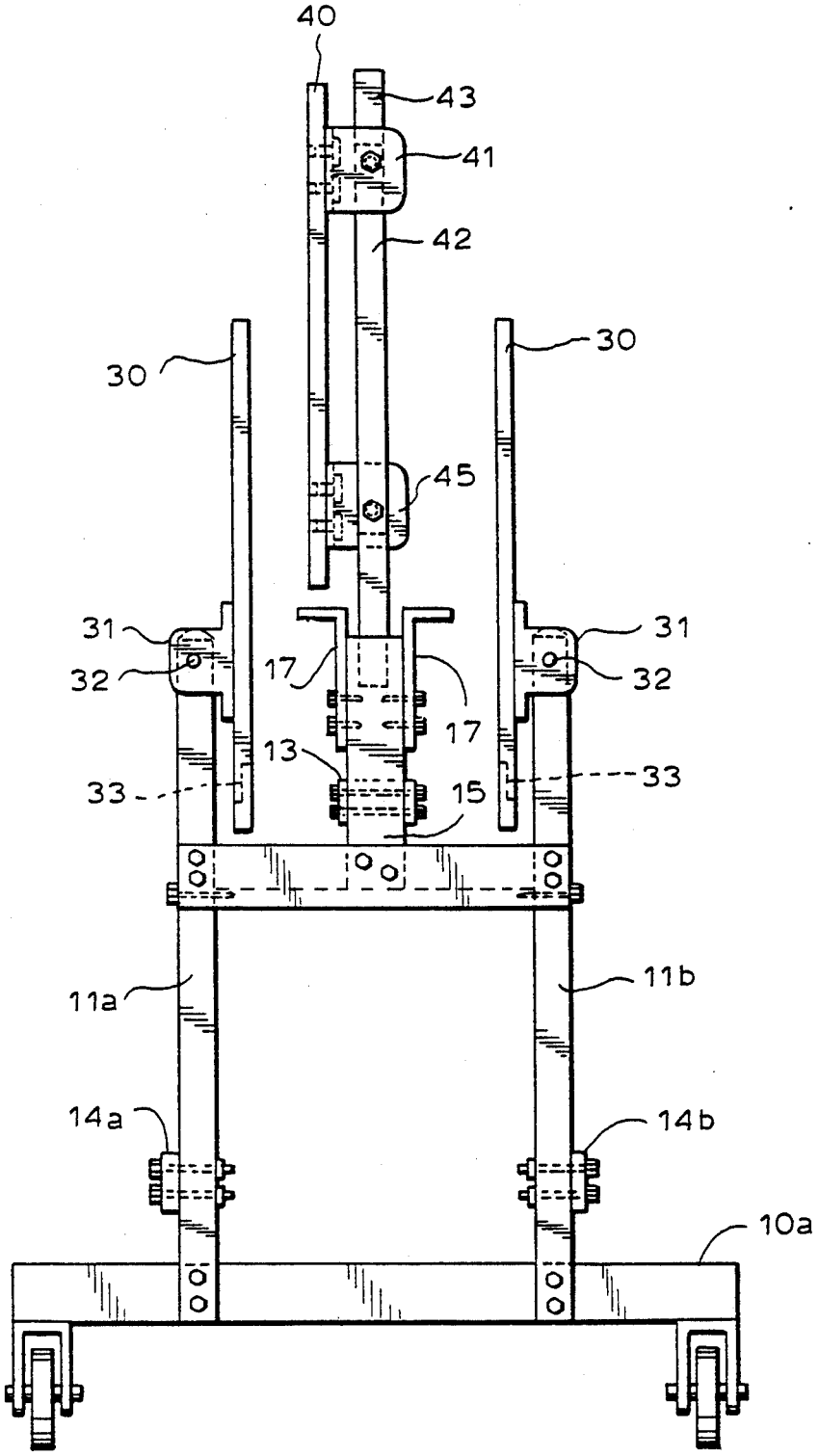
FIGS. 6A to 6D shows the foldable table assembly having buffet-table leaves in vertical storage, one-leaf, two-leaf, and two-leaf plus shelf configurations, respectively.
Figure 6B:
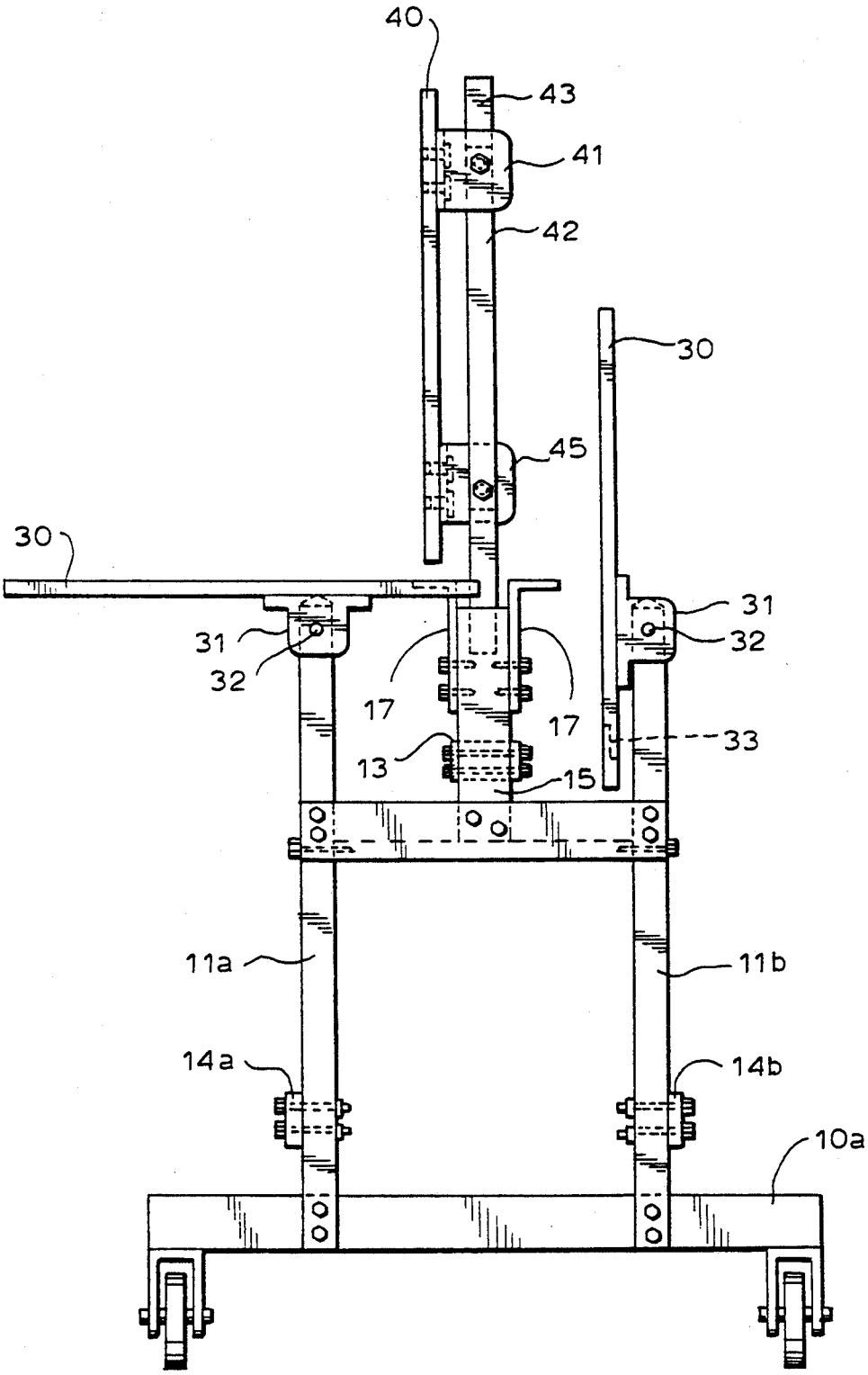
Figure 6C:
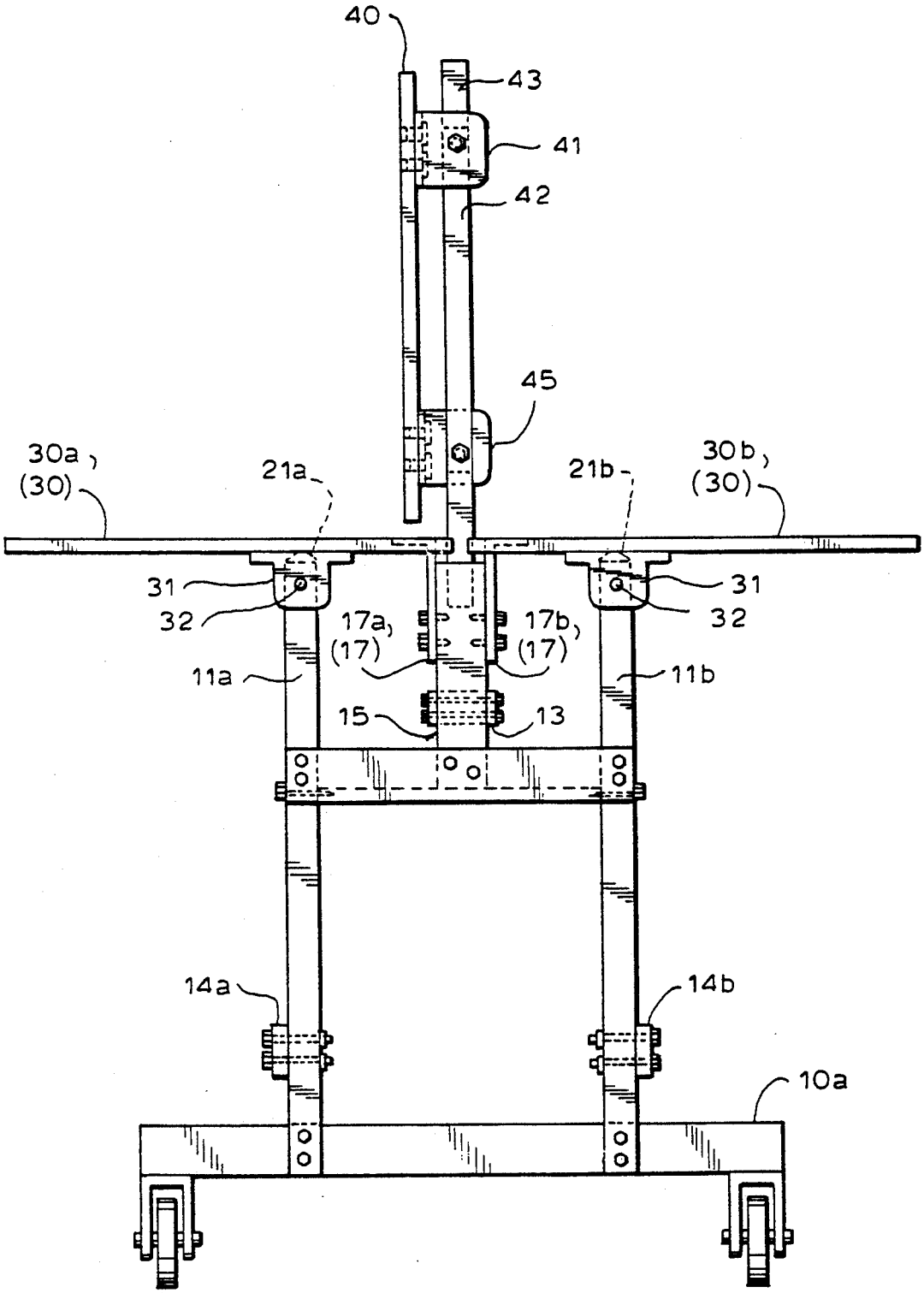
Figure 6D:
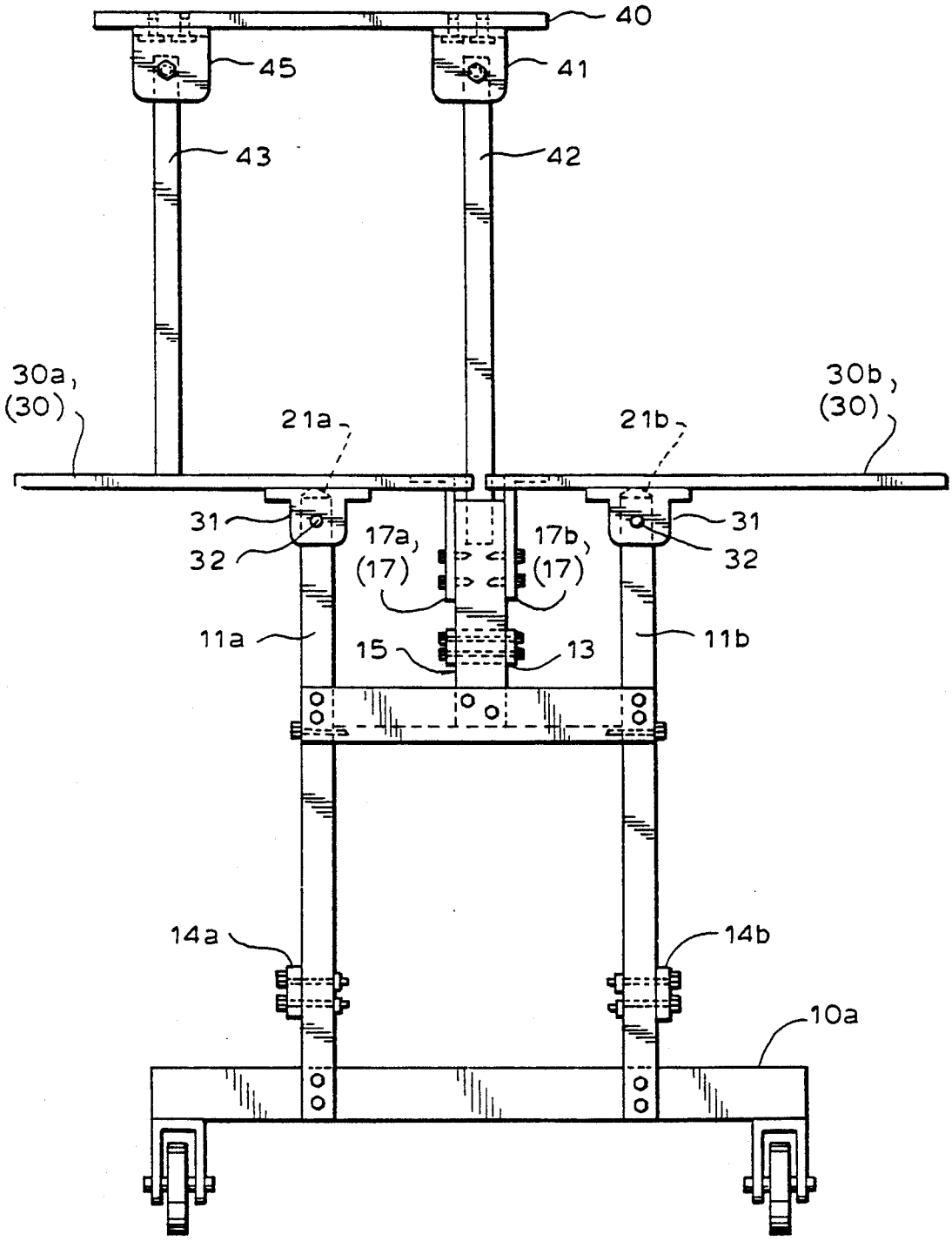

FIGS. 6A to 6D illustrate the different configurations permitted by the above-described table structure. In FIG. 6A the table leaves 30 and shelf 40 are pivoted vertically in the storage mode. All components are contained within the width of the upright pieces. The lower base pieces extend beyond the width of the upright pieces but does not interfere with compact storage as each assembly is stacked against another with the base pieces offset from each other. Wheels are mounted to the base pieces to make the foldable table mobile for convenient movement to locations where it is to be used. In FIGS. 6B and 6C, first one leaf and then the other leaf are opened to the horizontal positions. In FIG. 6D the upper shelf is opened to form a two-tiered structure on one transverse side. Alternatively, the two-tiered structure may be opened on one side, while the other table leaf is folded up, for example, to facilitate movement through doorways and hallways.

Figure 7A:
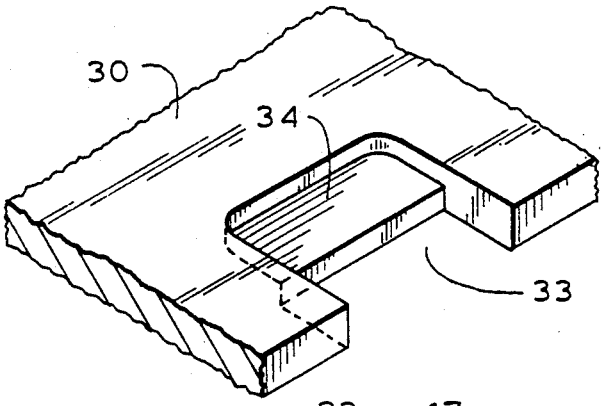
FIGS. 7A to 7C show details of the leaf stops of the end sections, leaf cutout portions, and pivot sections, respectively.
Figure 7B:
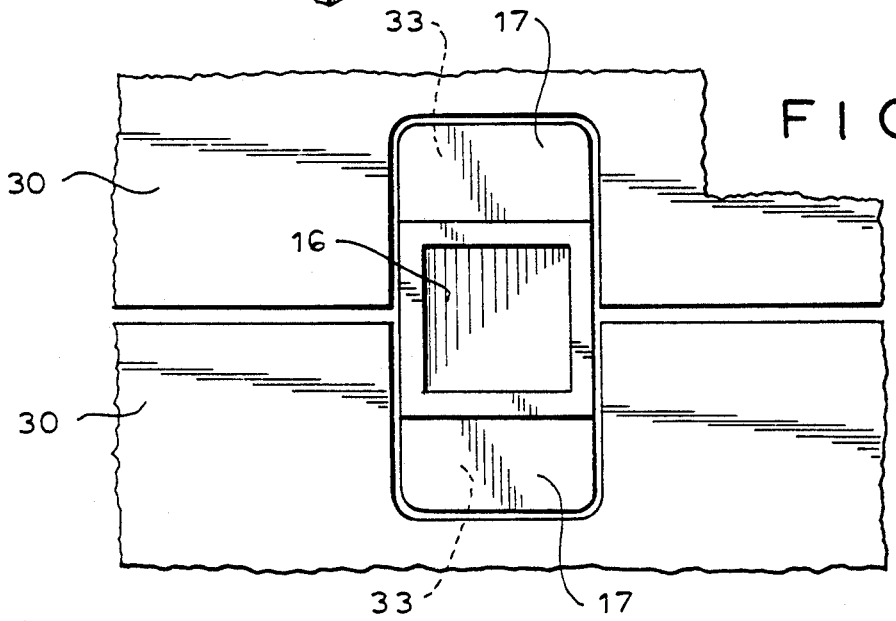
Figure 7C:
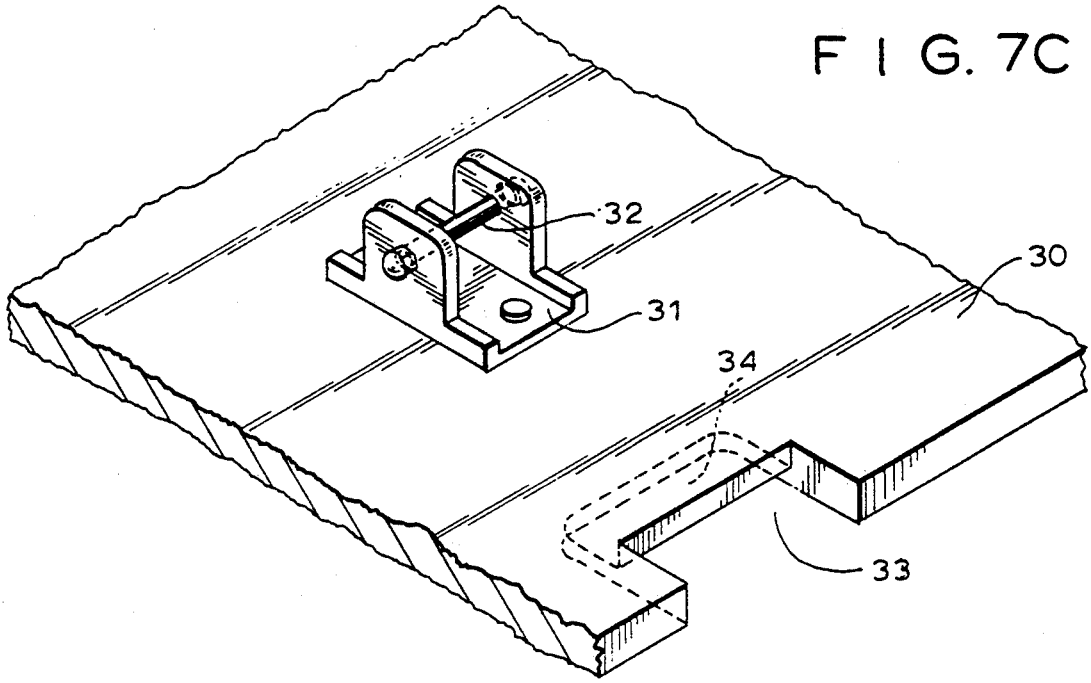

A detailed view of the cutout 33 and recessed step 34 of the table leaves is shown in FIG. 7A, and in FIG. 7B the leaf stops 17 are shown lying flush in the recessed steps 34 with both table leaves 30 in the extended positions. In FIG. 7C, the pivot section 31 and pivot pin 32 with threaded cap nut ar shown.

In a practical construction of the preferred embodiments, the base frame is made of steel tubing, angles, and channels which are welded together. The two lower longitudinal stretchers and the single upper stretcher are fastened with bolts. The base pieces have caster wheels at their ends (for a mobile table unit) and are attached to yokes at the lower ends of the upright pieces with bolts. The frame metal may be finished with chrome or powder paint. Aluminum sections may instead be used for a lighter weight table unit, and finished with anodized or powder paint.

The table leaves and shelves preferably have the same dimensions. For the buffer table configuration, they may come in different lengths, for example, 50 or 60 inches or more, and a width of 15 inches. The upright pieces may have a width of 11 inches, so that the leaves extend a total span of 30 inches and fold vertically to a storage width of 11 inches. The base pieces may extend a width of 22 inches to provide upright stability for anticipated loads on the table leaves. Including the caster wheels, the typical unit may have the table surface at a 30 inch height. The removable upper shelf may also measure 15 inches in width, and is mounted at its inner longitudinal edge to the upright posts at a height of 15 inches in order to provide the second tier surface 15 inches above the table surface and also allow it to be folded vertically without overlapping the base frame and end sections. The leaves and shelf may be formed with ¾ inch plywood and plastic laminate. A bottom shelf may also be provided below the table surface within the rectangular area defined by the upright pieces.

The banquet table configuration may have semicircular or oval leaves with a total span of 60, 66, or 72 inches. Folding legs (reference numeral 43 in FIG. 5) similar to those used for the upper shelf may be provided for stability at the far reaches of the leaves. The banquet table leaves are substituted simply by mounting them on the pivot mounts at the ends of the upright pieces. The upper shelf is removed from the slots in the end sections, and the slot holes may be capped. Alternatively, a one-sided or two-sided upper shelves may be used having a diameter set back from the diameter of the banquet table. For example, with a banquet table diameter of 60 or more inches, an upper shelf of 30 inches diameter may be used for holding bottles, coffee urns, or centerpiece decorations. The upper shelf can have two folding leaves on each side of the centerline provided with fold-out legs as previously described, or angle pieces for locking the shelves in position without the need for outboard legs. Although the basic approach of the invention is to provide table components which are foldable within the confines of the uprights for compact storage, it is also possible to provide a fixed upper shelf assembly which attaches to the base frame of the table unit.

In summary, the invention provides a foldable table that has a very sturdy base, yet folds up to a compact storage width, and also provides flexibility to be configured as a two-tiered registration table or buffet table, or a round or oval banquet table. The table unit is mobile and can be set up and broken down easily. The table components, i.e. leaves and shelf or shelves (in the case of the banquet table) are designed to be foldable within the confines of the uprights for compact storage. The two-tiered leaf and shelf on one side in the buffet table configuration can be used while the other leaf remains folded up, so that the unit has a narrower profile allowing it to be conveniently rolled through kitchen areas, doorways, hallways, and elevators in a near ready-to-operate state. The fixed base construction is much stronger than the type of tables which have collapsible supporting structures, yet the table unit can be nested compactly for storage.

Although the invention has been described with reference to certain preferred embodiments, many other variations may of course be made consistent with the basic principles of the invention. It is intended that the preferred embodiments and all such variations be included within the scope of the invention, as defined in the following claims.

I claim:

1. A foldable table assembly comprising:

(a) a base frame including first and second lower base pieces spaced apart in a longitudinal direction and extending in parallel with each other in a transverse direction perpendicular to the longitudinal direction, a first pair and a second pair of upright pieces, each pair of upright pieces having their lower ends fixed to a respective one of the base pieces and being spaced apart by a given width in the transverse direction and extending vertically in parallel, said upright pieces having pivot mounts provided respectively on their upper ends, and at least one longitudinal stretcher having its opposite ends fixed to the upright pieces to provide said base frame with structural rigidity;

(b) first and second end sections each respectively disposed at a midpoint of the given width between the spaced-apart upright pieces of said first and second pairs and each having a pair of leaf stops fixed on an upper end of the end section extending oppositely in the transverse direction a short length toward the corresponding upper ends of the upright pieces, wherein said first and second end sections define a centerline of the assembly between the upright pieces with the upper ends of the upright pieces being disposed on respective transverse sides of said centerline; and (c) first and second table leaves each extending a given length in the longitudinal direction and having a width in the transverse direction that is substantially greater than one-half the given width between the pairs of upright pieces, wherein each table leaf has a pair of pivot sections including pivot pins fixed to a lower surface thereof and spaced apart in the longitudinal direction for pivotably mounting each table leaf to respective pivot mounts on the upper ends of the upright pieces on each transverse side of the centerline of the assembly, and has a pair of cutout portions which are formed at an inner longitudinal edge of the table leaf spaced apart in the longitudinal direction for fitting around the respective end sections and abutting with the leaf stops to hold the table leaf in a horizontal position in conjunction with the pivot mounts on the upper ends of the upright pieces, said table leaves thereby each being independently pivotable on the respective pivot mounts between a horizontal position for use and a vertical position in which the inner longitudinal edges are released from the leaf stops and the table leaves are pivoted upright in parallel with each other between the upright pieces for storage.

2. A foldable table assembly according to claim 1, further including a longitudinally extending upper shelf on one transverse side of the centerline of the assembly having a pair of pivot sections spaced apart in the longitudinal direction along one longitudinal edge thereof which mounted respectively to upper ends or a pair of upright posts having their lower ends held respectively in the end sections of the base frame, and a pair of folding legs pivotably mounted along an opposite longitudinal edge of the upper shelf spaced apart in the longitudinal direction for supporting the upper shelf in a horizontal position on the table leaf on the corresponding transverse side, wherein the upper shelf is pivotable, upon folding of the legs, to a vertical position in parallel with the pair of upright posts.

3. A foldable table assembly according to claim 1, wherein said pivot sections of said table leaves are removable from said pivot mounts of said upright pieces to allow interchangeability of said table leaves.

4. A foldable table assembly according to claim 2, wherein said upright posts have their lower ends removably held in open slots in said end sections, so that said upper shelf can be removed from the base frame.

5. A foldable table assembly according to claim 1, wherein said table leaves are rectangular buffet table leaves.

6. A foldable table assembly according to claim 1, wherein said table leaves are semicircular or oval banquet table leaves.

7. A foldable table assembly according to claim 4, wherein said table leaves include a pair of rectangular buffet table leaves, and a pair of semicircular or oval banquet table leaves which can be interchanged with said buffet table leaves.

8. A foldable table assembly according to claim 1, wherein said end sections are welded to cross pieces extending between the respective pairs of upright pieces, and a single upper stretcher extends between the two end sections, and a pair of lower stretchers are provided extending longitudinally between respective upright pieces on each transverse side adjacent said base pieces.

9. A foldable table assembly according to claim 1, wherein said base pieces are provided with caster wheels to make the assembly mobile.

10. A foldable table assembly according to claim 1, wherein said pivot mounts are through holes provided at the upper ends of the upright pieces, and said pivot sections include brackets mounted to the lower surfaces of the table leaves and pivot pins held in said brackets.

11. A foldable table assembly according to claim 10, wherein pivot pins are retained in said pivot sections by threaded cap nuts to allow removal of the pivot pins for interchanging the table leaves.

12. A foldable table assembly according to claim 1, wherein said cutout portions include a recessed step in the areas to be abutted with said leaf stops, so that said leaf stops become flush with the upper surface of the table leaves extended in the horizontal position.

* * * * *